US006352353B1

(12) United States Patent
Liu

(10) Patent No.: US 6,352,353 B1
(45) Date of Patent: Mar. 5, 2002

(54) GRAPE-TYPE LIGHT BULB STRINGS

(76) Inventor: Chun Ming Liu, No. 430, Kau Fong Road, Hsinchu (TW)

( * ) Notice: Subject to any disclaimer, the term of this patent is extended or adjusted under 35 U.S.C. 154(b) by 0 days.

(21) Appl. No.: 09/737,750

(22) Filed: Dec. 18, 2000

(51) Int. Cl.[7] ..... F21P 1/02
(52) U.S. Cl. ..... 362/227; 362/249
(58) Field of Search ..... 362/227, 252, 362/806, 391, 807, 808, 249

(56) References Cited

U.S. PATENT DOCUMENTS 5,700,081 A * 12/1997 Mengle et al. ..... 362/227
5,860,731 A * 1/1999 Martinez ..... 362/252
5,868,490 A * 2/1999 Barthelmess ..... 362/252

* cited by examiner

*Primary Examiner*—Alan Cariaso
*Assistant Examiner*—Bao Truong
(74) *Attorney, Agent, or Firm*—Rosenberg, Klein & Lee

(57) ABSTRACT

This invention discloses a grape-type light bulb string which is consisted by a new winded skill to obtain a novel structure as grapes on a connecting wire with decorative lighting effect. The structure includes a main electrical wire a plurality of separated branch strings as a curtain-type lighting string, wherein a connecting wire of the branch string is provided with a set of several outward extended wires at a suitable interval thereof. A bulb assembly is connected at an end of each extended wire and each set of the outward extended wire with the bulb assembly becomes a unit as a connecting wire having mounted with many grapes thereon for obtaining a better lighting effect and improvement.

1 Claim, 2 Drawing Sheets

GRAPE-TYPE LIGHT BULB STRINGS

It is known that a curtain-type or a net light bulb string is often used in many places to obtain a decorative lighting effect. The said strings include a main electrical wire and a plurality of branch light bulb strings which are connected on the main wire as hanging thereof. When the branch strings are parallel, the light bulb string becomes a curtain-type one. And when the branch strings are winded intercrossly, the light bulb string becomes a net string.

The primary object of the invention is to provide an invented light bulb string to show a new outlook of a lighting string being different from any prior one. Now the features and advantages of the invention will be described in detail with reference to the accompanying drawings.

BRIEF DESCRIPTION OF THE INVENTION

DETAILED DESCRIPTION OF THE INVENTION

Figure 1:
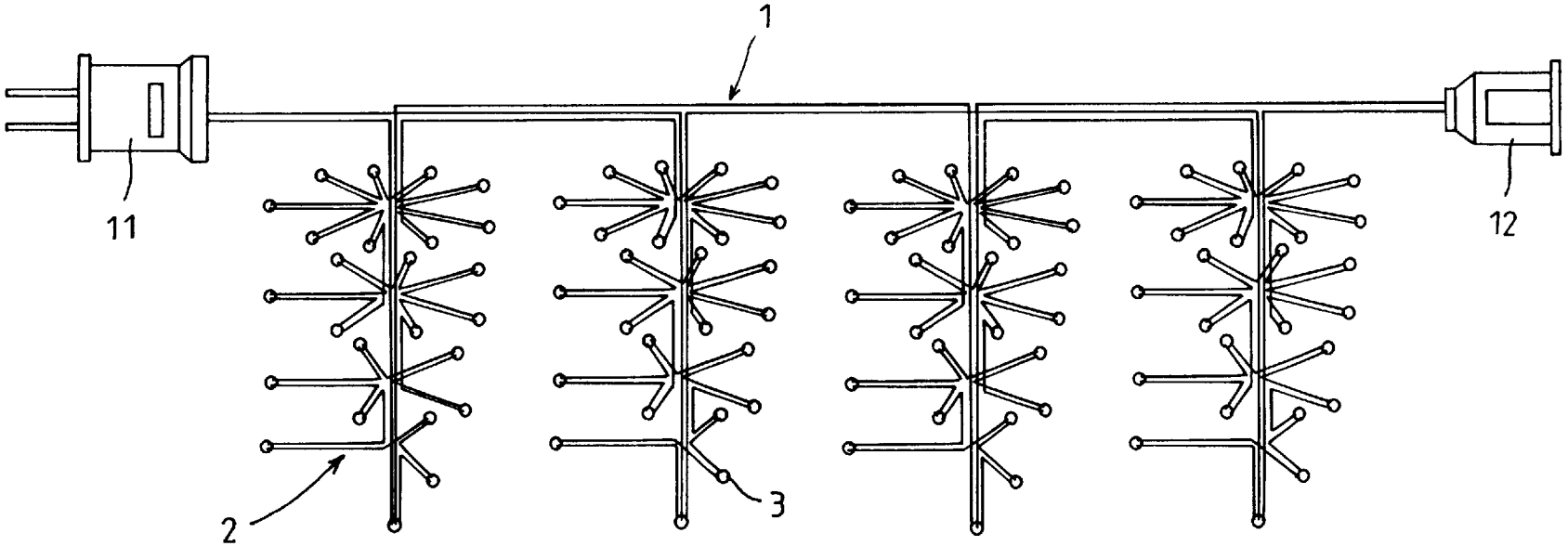
FIG. 1 is a schematic view showing a grape-type light bulb string according to the invention.
Figure 2:
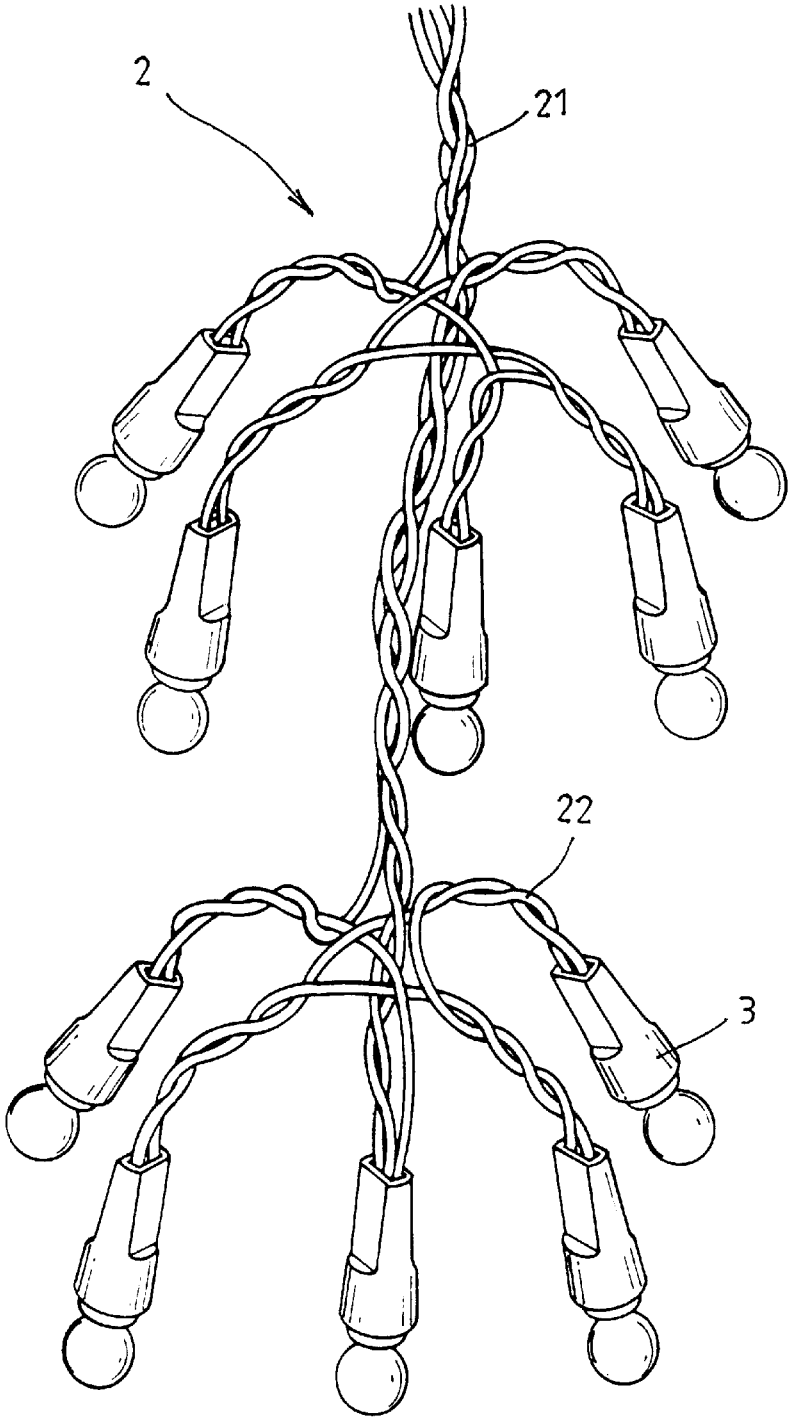
FIG. 2 is a partial enlarged perspective view of the light bulb string shown in FIG. 1.

With reference to the accompanying drawings, the invention comprises a main electrical wire (1) having a plug (11) at one end and a tail-socket (12) at the other end, and a plurality of separated branch strings (2) as a curtain-type lighting string. The characteristic of the present invention is that the three connector connecting wire (21) of the branch string (2) is provided with a set of several outward extended wires (22) at a suitable interval thereof. A light bulb assembly (3) is connected at an end of each extended wire (22). Each set of the outward extended wire (22) with a corresponding light bulb assembly (3) connected thereto becomes a unit appearing as though the three conductor connecting wire (21) has many grapes mounted thereon. And so the grape-type light bulb string is obtained according to the present invention.

In summary, the ingenious combination according to the invention allows a new decorative effect of a light bulb string which is different from any prior one. The outward extended wire with a related bulb assembly becomes a grape-type set on the connecting wire and provides an improvement on lighting effect. Therefore, the invention is a technical advance. Evidently it meets the requirements of granting a patent. We hereby file an application for a patent grant.

What is claimed is:

1. A cluster-type light bulb string comprising:

a main electrical feed cable;

a plurality of light cluster branches electrically connected to said main electrical feed cable;

each of said light cluster branches including a plurality of lighting groups, a first light bulb assembly, and a three-conductor cable extending longitudinally through said plurality of lighting groups, wherein said three-conductor cable is terminated at said first light bulb assembly at a distal end of said light cluster branch; and, each of said lighting groups being located at predetermined longitudinal intervals along a respective light cluster branch, each lighting group including a plurality of second light bulb assemblies and a plurality of outwardly extending two-conductor branches terminated at a respective one of said second light bulb assemblies.

* * * * *